US007500736B2

(12) United States Patent
Chikamoto

(10) Patent No.: US 7,500,736 B2
(45) Date of Patent: Mar. 10, 2009

(54) INKJET HEAD

(75) Inventor: Tadanobu Chikamoto, Nagoya (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 356 days.

(21) Appl. No.: 11/326,353

(22) Filed: Jan. 6, 2006

(65) Prior Publication Data

US 2006/0176332 A1 Aug. 10, 2006

(30) Foreign Application Priority Data

Jan. 7, 2005 (JP) ..... 2005-002146

(51) Int. Cl.
*B41J 2/045* (2006.01)

(52) U.S. Cl. ..... 347/71

(58) Field of Classification Search ..... 347/20, 347/65, 68, 71

See application file for complete search history.

(56) References Cited

U.S. PATENT DOCUMENTS

| | | | |
|---|---|---|---|
| 6,536,879 | B2 | 3/2003 | Ito et al. |
| 6,955,420 | B2 | 10/2005 | Ito |
| 2002/0036678 | A1 | 3/2002 | Ito et al. |
| 2004/0119790 | A1 | 6/2004 | Taira |
| 2005/0162485 | A1 | 7/2005 | Ito |

FOREIGN PATENT DOCUMENTS

| | | |
|---|---|---|
| CN | 2897647 | 5/2007 |
| EP | 1493581 A1 | 1/2005 |
| JP | 2002240272 | 8/2002 |
| JP | 200325570 | 1/2003 |
| JP | 2004136668 | 5/2004 |
| JP | 2004160874 | 6/2004 |

OTHER PUBLICATIONS

European Search Report (8 pages) in corresponding European patent application.

The State Intellectual Property Office of the People's Republic of China, Notification of the Third Office Action issued Nov. 14, 2008 for counterpart Patent Application No. CN 200610005749.0.

*Primary Examiner*—An H Do
(74) *Attorney, Agent, or Firm*—Baker Botts L.L.P.

(57) ABSTRACT

An inkjet head includes an ink flow path unit. The ink flow path unit includes a common ink chamber and plural individual ink flow paths. Each individual ink flow path extends from the common ink chamber to a nozzle through a pressure chamber. The ink flow path unit includes plural stacked plates including first and second plates. At least a portion of the individual ink flow paths are formed in the stacked plates. The first plate is formed with plural holes that form the portion of the individual ink flow paths. One surface of the first plate is formed with plural annular escape grooves that surround the holes, respectively. All the annular escape grooves communicate with an atmosphere.

16 Claims, 11 Drawing Sheets

INKJET HEAD

This application is based upon and claims the benefit of priority from Japanese Patent Application No. 2005-2146 filed on Jan. 7, 2005; the entire contents of which are incorporated herein by reference.

BACKGROUND OF THE INVENTION

1. Field of the Invention

The invention relates to an inkjet head, which ejects ink onto a recording medium.

2. Description of the Related Art

An inkjet head, whose flow path unit containing ink flow paths therein is formed of a plurality of stacked plates, has hitherto been available as an inkjet head, which ejects ink from nozzles. For instance, an inkjet head described in US 2004/119790 A1 contents of which are incorporated herein by reference in its entirety has a flow path unit including a manifold and a plurality of individual ink flow paths, each of which extends from the manifold to a nozzle through a pressure chamber. Further, the flow path unit is formed of a plurality of stacked metal plates. The plurality of metal plates are bonded together with an adhesive. When the plates are bonded together, excessive adhesive flows, to some extent, into the individual ink flow paths. In order to minimize the amount of adhesive flowing into the ink flow paths, escape grooves for making an excessive adhesive to escape is formed in each of mating faces of the plurality of metal plates so as to surround holes forming the individual ink flow paths.

SUMMARY OF THE INVENTION

However, when the plurality of escape grooves differ from each other in the amount of adhesive escaping, the amount of adhesive flowing into the individual ink flow paths from holes corresponding to the escape grooves changes from one individual ink flow path to another. As a result, the area of an ink flow path (the resistance of the flow path) changes from one ink flow path to another. In particular, when variations exist in the areas of the flow paths located near nozzles, variations arise among the plurality of nozzles in terms of the speed of an ink droplet ejected from nozzles, an ink ejection characteristic, or the like, to thus degrade print quality.

The invention attempts to control variations in the amount of adhesive flowing into individual ink flow paths, to thus render an ink ejection characteristic uniform.

According to one aspect of the invention, an inkjet head includes an ink flow path unit. The ink flow path unit includes a common ink chamber and a plurality of individual ink flow paths. Each of the individual ink flow paths extends from the common ink chamber to a nozzle through a pressure chamber. The ink flow path unit includes a plurality of stacked plates containing first and second plates. At least a portion of the plurality of individual ink flow paths are formed in the plurality of stacked plates. The first plate is formed with a plurality of holes that form the portion of the plurality of individual ink flow paths. One surface of the first plate is formed with a plurality of annular escape grooves surround the plurality of holes, respectively. All the plurality of annular escape grooves communicate with an atmosphere. The plurality annular escape grooves may allow an adhesive used for bonding the first plate to the second plate to escape thereinto.

In this inkjet head, one surface of the first plate, which is formed with a plurality of holes that form the portion of the plurality of individual ink flow paths, is formed with a plurality of annular escape grooves that allow an adhesive used for bonding the first plate to the second plate to escape thereinto, and surround the plurality of holes, respectively. When the second plate is bonded to the one surface of the first place with an adhesive, excess adhesive is allowed to escape into the annular escape grooves. Therefore, an amount of adhesive flowing into the holes decreases. Furthermore, all the plurality of annular escape grooves communicate with the atmosphere. Therefore, conditions under which the adhesive flows into the annular escape grooves when the first plate and the second plate are bonded together are equivalent in relation to all the annular escape grooves. Accordingly, the amounts of adhesive flowing into the plurality of flow-path formation holes are made uniform, and hence variations in the ejection characteristic of ink ejected from the plurality of nozzles can be suppressed According to another aspect of the invention, An inkjet head includes an ink flow path unit. The ink flow path unit includes a common ink chamber and a plurality of individual ink flow paths. Each of the individual ink flow paths extends from the common ink chamber to a nozzle through a pressure chamber. The ink flow path unit includes a plurality of stacked plates containing first and second plates. At least a portion of the plurality of individual ink flow paths are formed in the plurality of stacked plates. The first plate is formed with a plurality of holes that form the portion of the plurality of individual ink flow paths. The plurality of holes are arranged to be divided into a plurality of hole groups. One surface of the first plate is formed with a plurality of annular escape grooves that surround the plurality of holes, respectively. The annular escape grooves, which are arranged to be divided into a plurality of groove groups. Each groove group corresponds to one of the hole groups. The annular escape grooves belonging to each groove group communicate with each other. Each group of the annular escape grooves is closed. The plurality annular escape grooves may allow an adhesive used for bonding the first plate to the second plate to escape thereinto.

As mentioned above, with regard to all the plurality of hole groups, the annular escape grooves, which are arranged to be divided into a plurality of groove groups, each groove group corresponds to one of the hole groups, and the annular escape grooves belonging to each groove group communicate with each other. Each groove group of the annular escape grooves is closed. Thus, conditions under which the adhesive flows into the annular escape grooves are substantially equivalent among all the annular escape grooves. Consequently, the amounts of adhesive flowing into the plurality of holes are made uniform, and hence variations in the ejection characteristic of ink ejected from the plurality of nozzles can be suppressed.

DETAILED DESCRIPTION OF EMBODIMENTS OF THE INVENTION

Figure 1:
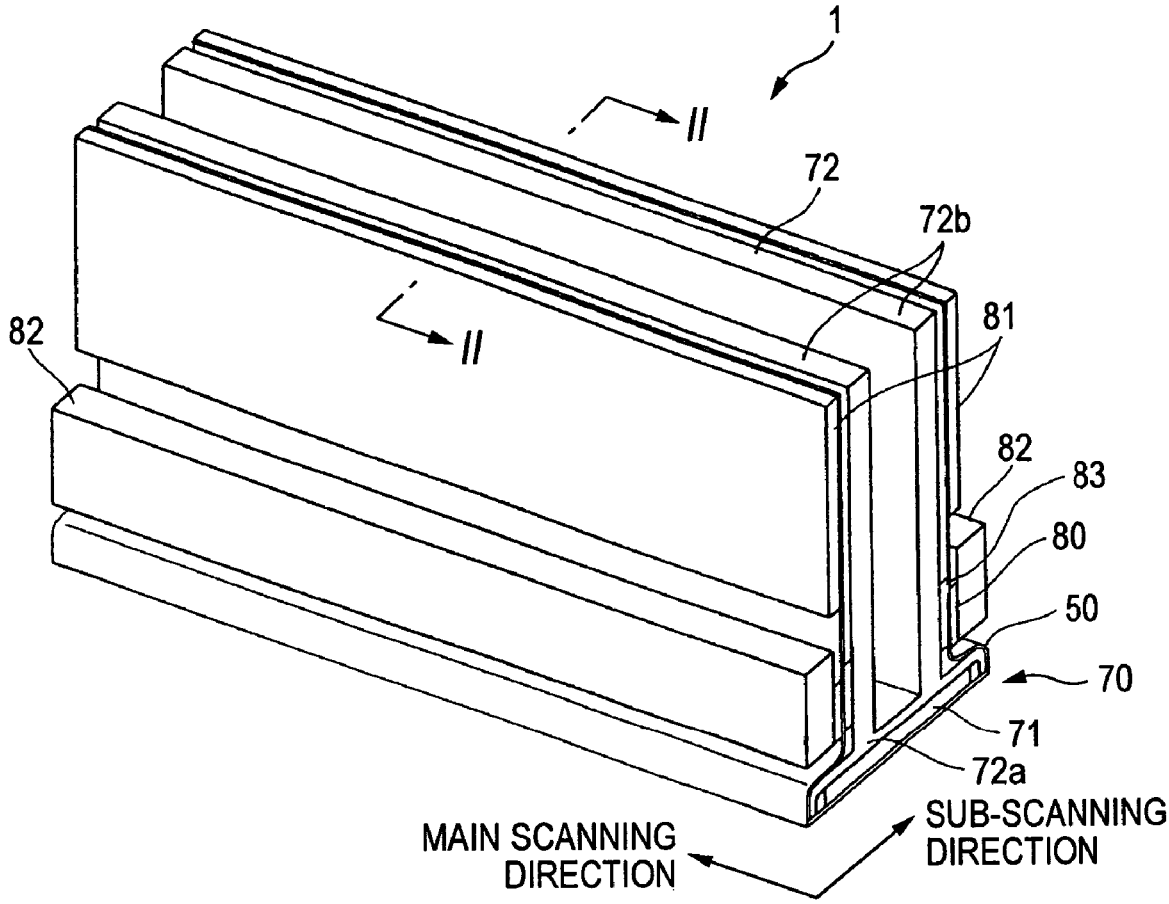
FIG. 1 is a perspective view of an inkjet head according to an embodiment of the invention.
Figure 2:
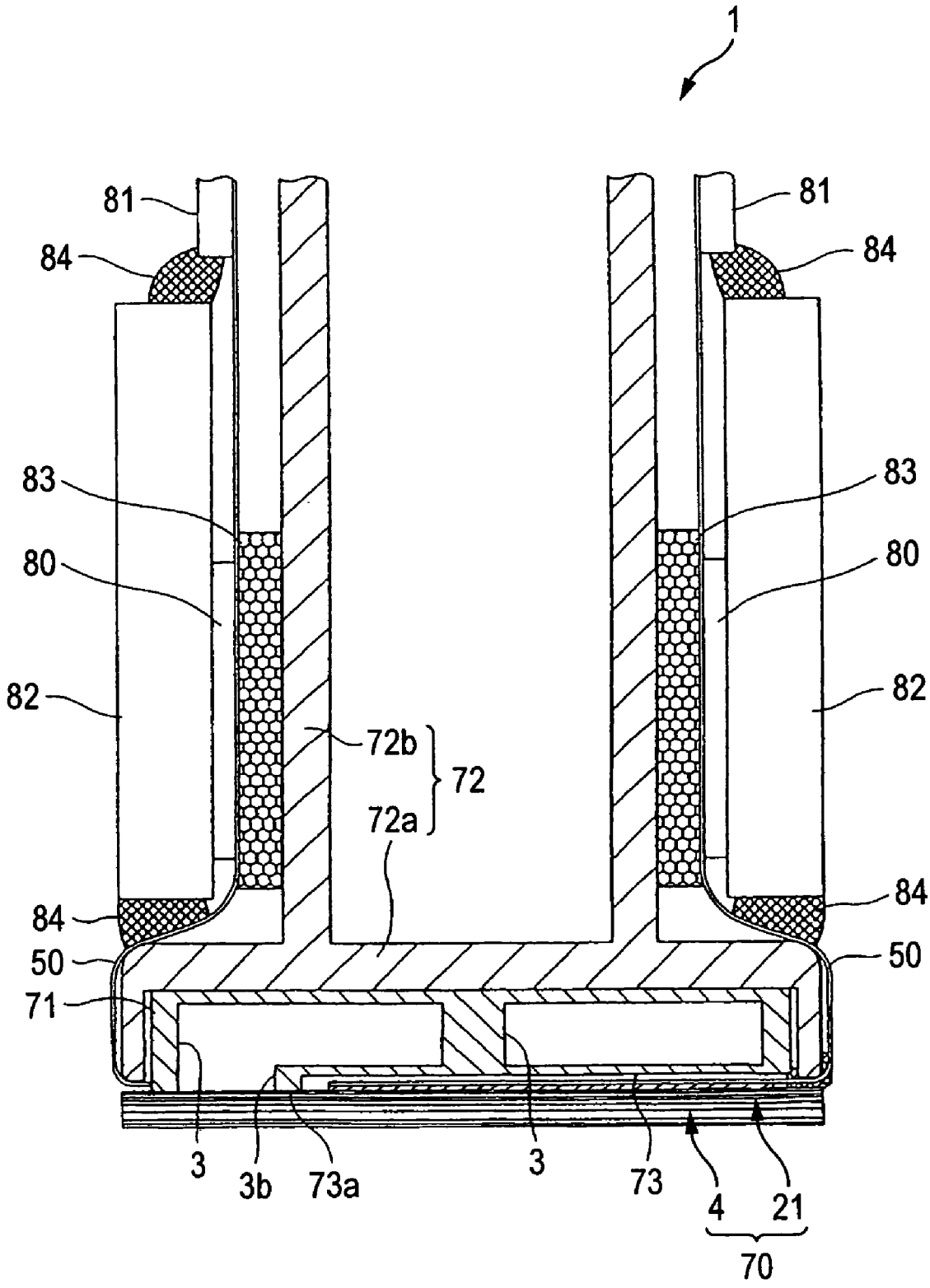
FIG. 2 is a section view taken along line II-II in FIG. 1.

Embodiments of the invention will be described with reference to the drawings. FIG. 1 is a perspective view of an inkjet head. FIG. 2 is a section view taken along line II-II shown in FIG. 1. The inkjet head of this embodiment is provided in an inkjet printer (omitted from the drawings), and is for ejecting ink onto a sheet of paper being conveyed, to thus record an image on the sheet of paper. As shown in FIGS. 1 and 2, an inkjet head 1 includes a head main body 70, a base block and a holder 72. The head main body 70 has a rectangular planar shape and extends in a main scanning direction for ejecting ink on a sheet of paper. The base block 71 is in an upper part of the head main body 70. The base block 71 is formed with two ink reservoirs 3, which serve as flow paths for ink to be supplied to the head main body 70. The holder 72 holds the head main body 70 and the base block 71.

The head main body 70 includes a flow path unit 4 in which individual ink flow paths 32 (see FIG. 5) are formed, and a plurality of actuator units 21 bonded to the upper surface of the flow path unit 4. The flow path unit 4 and the actuator units 21 are formed of thin-plates laminated body, which are formed by bonding together a plurality of laminated thin plates. As shown in FIG. 2, a flexible printed circuit board (FPC: Flexible Printed Circuit) 50 is bonded to the upper surface of the actuator unit 21, and both sides of the FPC 50 are withdrawn laterally. The base block 71 is made of a metallic material, such as stainless steel, and the ink reservoirs 3 in the base block 71 are essentially-rectangular-parallelepiped hollow areas formed along the longitudinal direction of the base block 71.

A portion of a lower surface 73 of the base block 71 located in the vicinity of an opening 3*b* protrudes downward in relation to the neighboring area thereof. The base block 71 is in contact with the flow path unit 4 at only a proximate portion 73*a* of the lower surface 73 close to the opening 3*b*. Therefore, the portions of the lower surface 73 of the base block 71 excluding the proximate portion 73*a* close to the opening 3*b* is separated from the head main body 70. The actuator units 21 are provided in this separate space. Specifically, the portion of the lower surface 73 of the base block 71 located around the opening 3*b* protrudes, to thus come into contact with the flow path unit 4. In the portions other than the protruding portion, the actuator units 21 and the FPC 50 are provided in the separate space, which is defined between the flow path unit 4 and the lower surface 73 of the base block 71, with a predetermined gap space.

The holder 72 includes a grip portion 72*a* and a pair of protruding portions 72*b*, which are shaped like flat plates extending in the vertical direction from the upper surface of the grip portion 72*a*. The base block 71 is fixed to a recess formed in a lower surface of the grip portion 72*a* of the holder 72 with an adhesive. The FPCs 50 bonded to the actuator units 21 are arranged so as to run along the surfaces of the protruding portions 72*b* of the holder 72 via elastic members 83, such as sponge. Driver ICs 80 are provided on the FPCs 50. The FPCs 50 are electrically connected to the driver ICs 80 by means of soldering, so that drive signals output from the driver ICs 80 are transmitted to the actuator units 21 (which will be detailed later) of the head main body 70.

Substantially-rectangular-parallelepiped heat sinks 82 are provided on an exterior surface of each of the driver ICs 80 and in intimate contact therewith. Heat generated by the driver ICs 80 is dissipated outside through the heat sinks 82. Substrates 81, which are electrically connected to the driver ICs 80 through the FPCs 50, are provided at positions above the driers ICs 80 and the heat sinks 82 as well as outside the FPCs 50. Space between an upper surface of the heat sink 82 and the substrate 81 and space between a lower surface of the heat sink 82 and the FPC 50 are filled with a sealing member 84 for preventing intrusion of dust or ink into the inkjet head 1 through the spaces.

Figure 3:
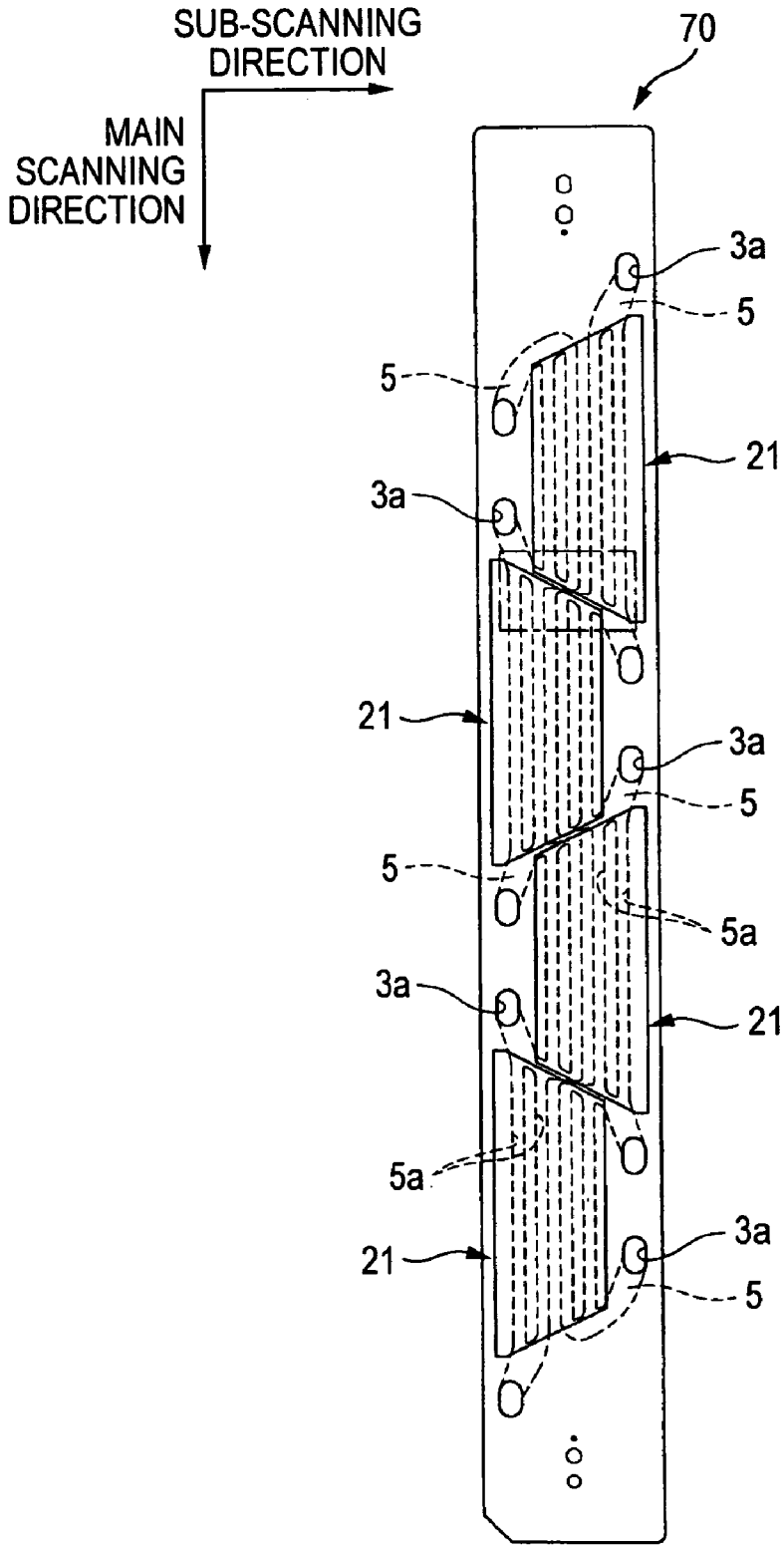
FIG. 3 is a plan view of a head main body.

FIG. 3 is a plan view of the head main body 70. As shown in FIG. 3, the flow path unit 4 has a shape of a rectangular plane, which elongates in one direction (i.e., the main scanning direction). The opening 3*b* formed in the base block 71 (see FIG. 2) communicates with manifolds 5 through openings 3*a* formed in the flow path unit 4. The extremity of each manifold 5 branches out, and sub-manifolds 5*a* (serving as common ink chambers) extend in the longitudinal direction of the flow path unit 4 from the branch positions.

The flow path unit 4 has four trapezoidal regions in each of which a plurality of pressure chambers 10 and a plurality of nozzles 8 (see FIG. 4) are arranged. Four actuator units 21 are bonded to the upper surface of the flow path unit 4 in correspondence with the respective trapezoidal regions. The actuator units 21 are arranged in two rows of a staggered pattern so as to avoid the openings 3*a*. Each of the actuator units 21 has the shape of a trapezoidal plane. A pair of parallel sides (i.e., upper and lower sides) of each trapezoid are arranged to extend along the longitudinal direction of the flow path unit 4. Further, oblique sides of adjacent actuator units 21 partially overlap when viewed from the widthwise direction (the sub-scanning direction) of the flow path unit 4. Meanwhile, the plurality of openings 3*a* are also arranged in two rows along the longitudinal direction of the flow path unit 4. Five openings 3*a* in each row, namely, a total of ten openings 3*a* are formed in positions where the openings 3*a* do not interfere with the actuator unit 21. Specifically, each row of the openings 3*a* is adjacent to the long side of the flow path unit 4. As a whole, the rows of the openings 3*a* are arranged in a staggered pattern as are the actuator units 21. A total of four sub-manifolds 5*a* communicating with the openings 3*a* extend below the respective actuator units 21 (i.e., within the flow path unit 4) while being adjacent to each other.

Figure 4:
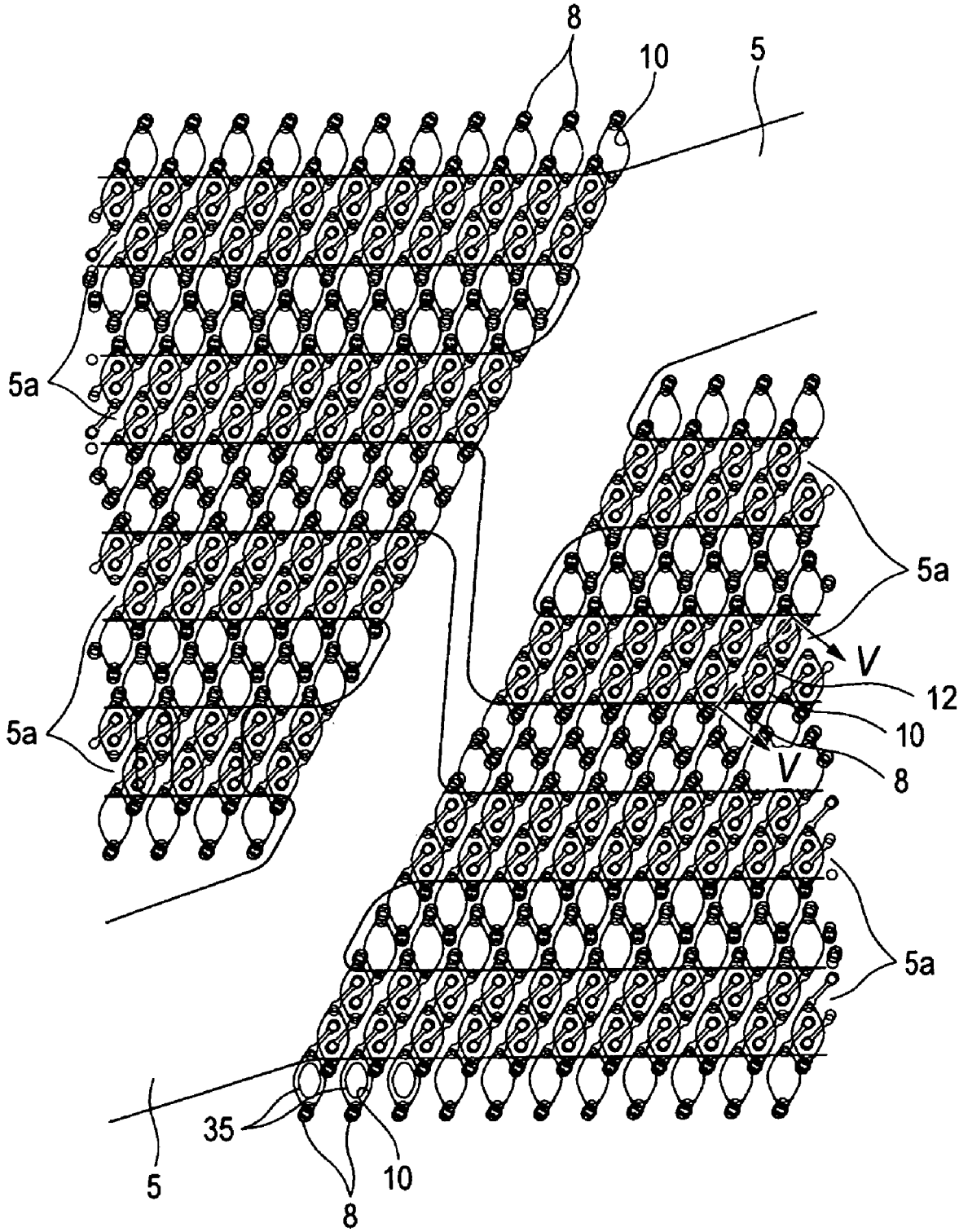
FIG. 4 is an enlarged view of a region surrounded by an alternate long and short dashed line in FIG. 3.

FIG. 4 is an enlarged view of a region surrounded by an alternate long and short dashed line in FIG. 3. For the sake of convenience of explanation, the outer shapes of the actuator units 21, which ordinarily should be indicated by solid lines, are not illustrated. In contrast, ink flow paths such as the nozzles 8 and apertures 12, which are provided in the flow path unit 4 and should ordinarily be indicated by broken lines, are indicated by solid lines. As shown in FIG. 4, a plurality of pressure chambers 10 are arranged on the upper surface (front surface) of the flow path unit 4 in a matrix pattern. The lower surface (the back surface) of the flow path unit 4 constitutes an ink ejection region where a plurality of nozzles 8 communicating with the plurality of pressure chambers 10 are arranged in a matrix pattern.

As shown in FIG. 4, the plurality of pressure chambers 10 are arranged in a matrix pattern in two directions, that is, the extending direction of the sub-manifold 5*a* (the main scanning direction) and a direction inclined from the extending direction at a predetermined angle. Each of the pressure chambers 10 has a substantially-rhombic shape whose corners are rounded. A longer diagonal line of the rhombic shape is parallel to the widthwise direction of the flow path unit 4. One end of each of the pressure chambers 10 communicates with one of the nozzles 8, and the other end thereof communicates with one of the sub-manifolds 5*a*, which functions as a common ink chamber, through the corresponding aperture 12. Further, individual electrodes 35 of the actuator unit 21, each of which has a shape analogous to but smaller than that of the pressure chamber 10, are provided in an overlapping position with the pressure chambers 10 when viewed from above. For the sake of simplicity, FIG. 4 shows only some of the plurality of individual electrodes 35.

Figure 5:
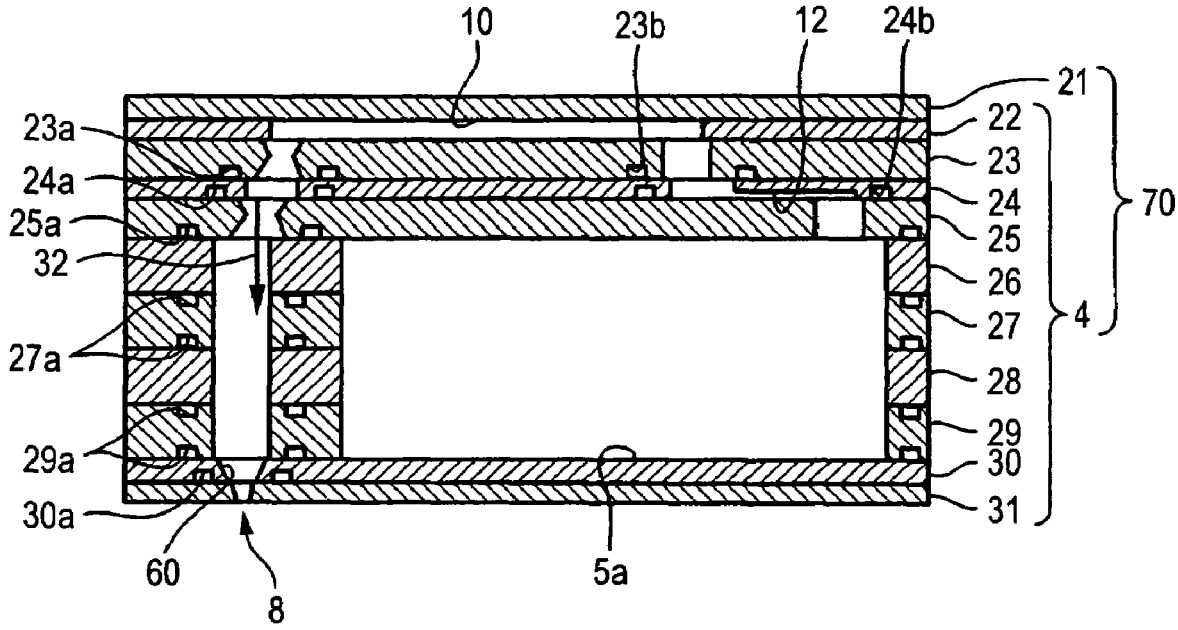
FIG. 5 is a section view taken along line V-V in FIG. 4.

The section structure of the head main body 70 will now be described with reference to FIG. 5. FIG. 5 is a section view taken along line V-V shown in FIG. 4. As shown in FIG. 5, the nozzle 8 communicates with the sub-manifold 5*a* through the pressure chamber 10 and the aperture 12. Specifically, the individual ink flow paths 32, each of which extends from the sub-manifold 5*a* to the nozzle 8 through the aperture 12 and the pressure chamber 10, are formed in the head main body 70. In this embodiment, the individual ink flow path 32 extends toward one end of the pressure chamber 10 formed in the surface of the flow path unit 4 and communicates with the nozzle 8 formed in the back surface of the flow path unit 4 through the other end of the pressure chamber 10. As a whole, each individual ink flow path 32 has a bow shape, which takes the pressure chamber as the apex. Thus, smooth ink flow is realized.

The head main body 70 has the actuator units 21 and the flow path units 4. Among them, each of the actuator units 21 has four stacked piezoelectric sheets 41 to 44 (see FIG. 11). Each of these piezoelectric sheets 41 to 44 is formed from a lead-zirconate-titanate (PZT)-based ceramic material possessing ferroelectricity. As will be described later, the piezoelectric sheet 41 of the uppermost layer has a portion, which acts an active layer upon application of an electric field (hereinafter described simply as a "layer having an active layer"), but the piezoelectric sheets 42 to 44 of the remaining three layers are non-active layers. Meanwhile, Flow path units 4 have a structure in which ten plates, i.e., a cavity plate 22, a base plate 23, an aperture plate 24, a supply plate 25, manifold plates 26, 27, 28, 29, a cover plate 30, and a nozzle plate 31, are stacked. These ten plates 22 to 31 are respectively metal plates made of stainless steel or the like.

The plurality of pressure chambers 10 are formed in the cavity plate 22 in a matrix pattern. Communication holes each extending from the pressure chamber 10 to the aperture 12 and other communication holes each extending from the pressure chamber 10 to the nozzle 8 are formed in the base plate 23. The apertures 12 formed by half-etching and communication holes each extending from the pressure chamber 10 to the nozzle 8 are formed in the aperture plate 24. Communication holes each extending from the aperture 12 to the sub-manifold 5*a* and other communication holes each extending from the pressure chamber 10 to the nozzle 8 are formed in the supply plate 25. Moreover, the manifold 5 (see FIGS. 3 and 4), the sub-manifold 5*a* branched out of the manifold 5, and the communication holes each extending from the pressure chamber 10 to the nozzle 8 are formed in the four manifold plates 26 to 29. Communication holes 60 each extending from the pressure chamber 10 to the nozzle 8 are formed in the cover plate 30. The plurality of nozzles 8 arranged in the matrix pattern are formed in the nozzle plate 31.

The ten metal plates 22 to 31 are stacked while being aligned with each other so that the individual ink flow paths 32, such as that shown in FIG. 5, is formed. The ink supplied to the manifold 5 goes upward from the sub-manifold 5*a* branched out of the manifold 5, and flows horizontally through the aperture 12. The ink goes further upward, and again flows horizontally in the pressure chamber 10. The ink further flows in an obliquely-downward direction away from the aperture 12, to thus run toward the nozzle 8 located in the vertically-downward direction.

Figure 6:
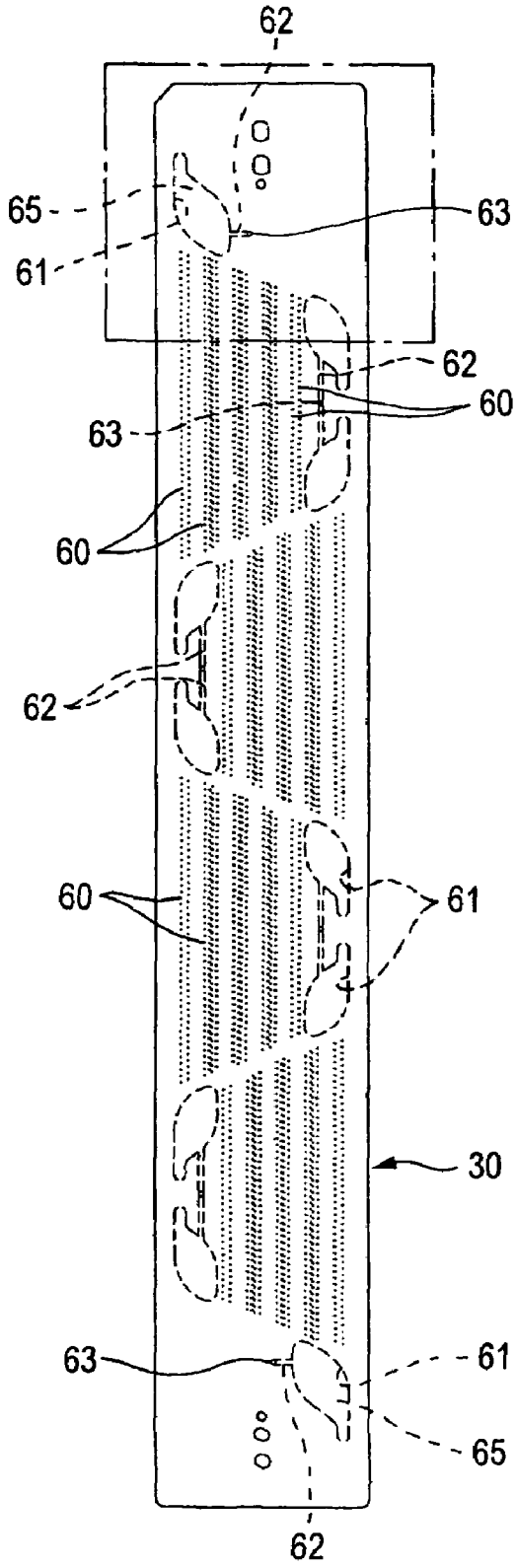
FIG. 6 is a plan view of a cover plate.

As shown in FIG. 6, recessed portions 61, which will become damper chambers 65, are formed in the lower surface of the cover plate 30 (the face to be bonded to the nozzle plate 31) in positions corresponding to portions of the manifolds 5 communicating with the openings 3*a* (see FIG. 3). In this illustration, the recessed portions 61 should originally be indicated by broken lines, but are indicated by solid lines for the sake of convenience of explanation. The recessed portions 61 are formed by means of half-etching, and are sealed with the nozzle plate 31, to thereby constitute the damper chambers 65. This damper chamber 65 absorbs pressure fluctuations, which propagate from the pressure chamber 10 to the manifold 5 when the ink in the pressure chamber 10 is pressurized by the actuator unit 21 to be described later. The damper chambers 65 communicate with the atmosphere through grooves 62, atmosphere communication holes 63, and atmosphere communication holes (omitted from the drawings) formed in the respective eight plates 22 to 29, which are located above the cover plate 30. Therefore, the damper chambers 65 can absorb fluctuations in the pressure of the ink in the manifold 5 more effectively.

The ten plates 22 to 31 are bonded by stacking the ten plates 22 to 31 in a state where the adhesive agent is applied to each mating face of the respective plate. At that time, when the stacked plates 22 to 31 are subjected to pressure, the adhesive flows into part of the holes constituting the individual ink flow paths 32 (i.e., the communication holes connecting the nozzles 8 to the apertures 12, the communication holes connecting the nozzles 8 to the pressure chambers 10, or the like). On some occasions, there may arise a case where an individual ink flow path 32 is partially clogged up. As shown in FIG. 5, a plurality of escape grooves, such as annular escape grooves 23*a*, 23*b*, 24*a*, 24*b*, 25*a*, 27*a*, 27*a*, 29*a*, 29*a*, 30*a* and the like, which surround the communication holes and the apertures 12, are formed in the lower surfaces of the plates 23 to 30. Thereby, the excessive adhesive can escape into these escape grooves.

However, if variations arise among the plurality of annular escape grooves formed in the respective plates in terms of the amount of adhesive escaping thereto, variations also arise in the amount of adhesive flowing into the holes formed in the plates. As a result, the plurality of individual ink flow paths 32 differ from each other in flow resistance. Especially, the nozzles 8, which eject ink, have a very small diameter (of the order of, e.g., about 20 μm). Therefore, if variations arise in the amount of adhesive flowing into the communication holes 60 or into the nozzles 8 (see FIG. 5) communicating with the communication holes 60 when the nozzle plate 31 (serving as the second plate) formed with the nozzles 8 and the cover plate 30 (serving as the first plate) provided thereon are bonded together with an adhesive, variations arise in the droplet speed and ejection characteristic of the ink ejected from the nozzles 8, which in turn deteriorates print quality.

In order to reduce the variations arising in the amount of adhesive flowing into the communication holes 60 formed in the cover plate 30 or into the nozzles 8 of the nozzle plate 31, the inkjet head 1 of this embodiment is configured so that substantially equal amounts of adhesive flow into the plurality of annular escape grooves 30*a* surrounding the plurality of communication holes 60. The specific configuration will be described hereinbelow in detail.

Figure 7:
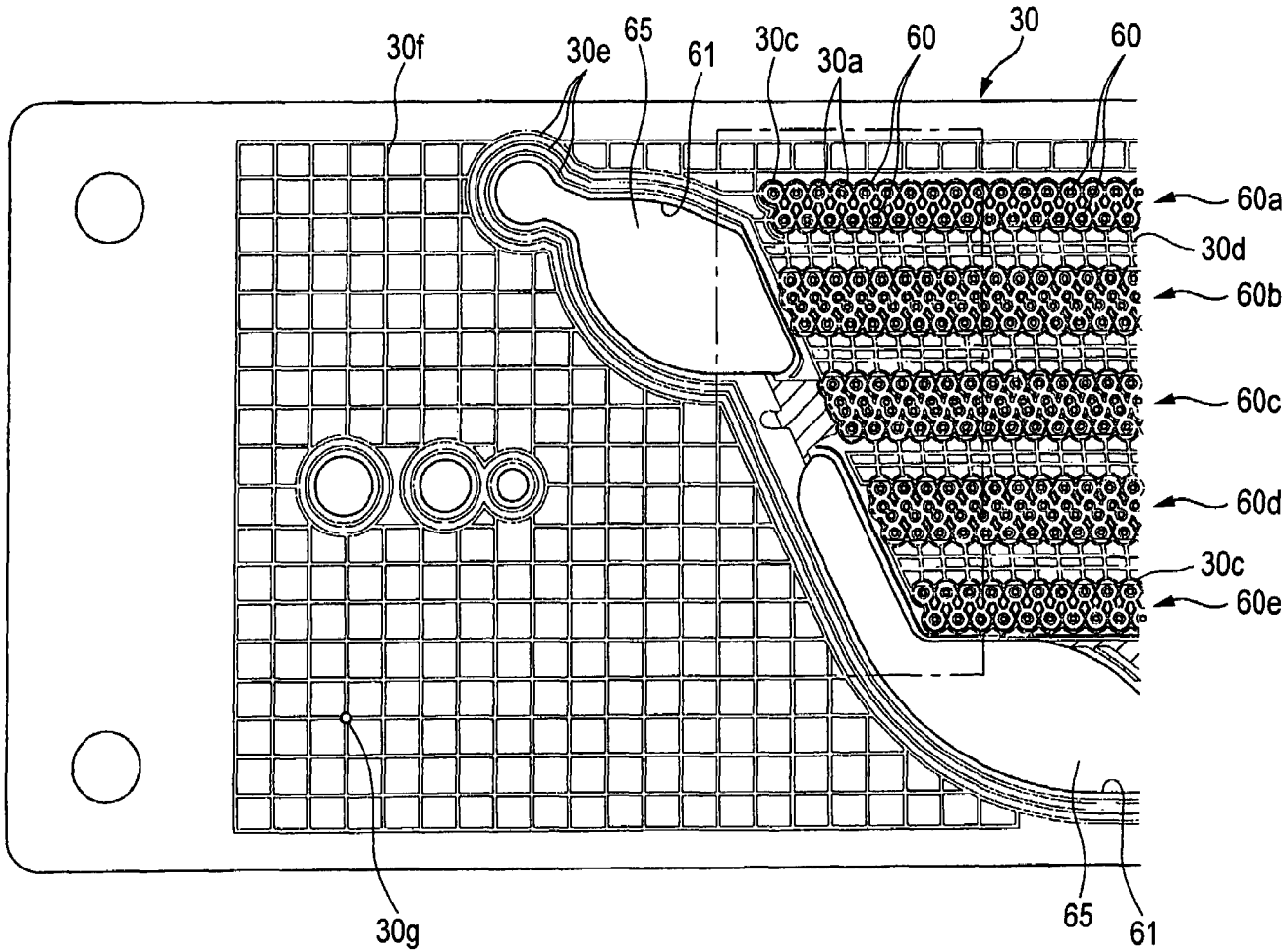
FIG. 7 is a view of a region of the cover plate, which is shown in FIG. 6 and surrounded by an alternate long and short dashed line, when viewed from the back.
Figure 8:
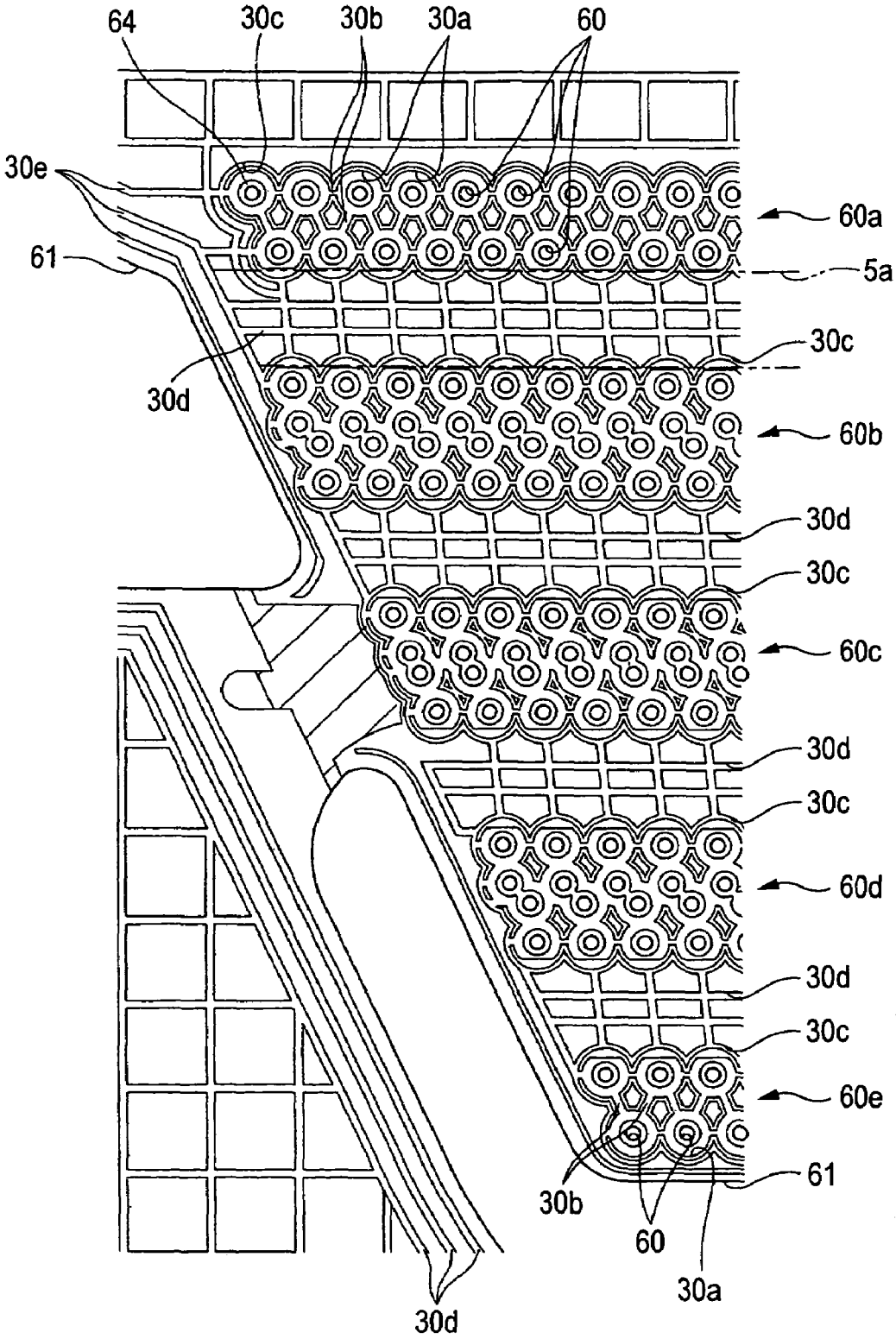
FIG. 8 is an enlarged view of a region surrounded by an alternate long and short dashed line in FIG. 7.

FIG. 7 is a view of a region surrounded by an alternate long and short dashed line shown in FIG. 6 when viewed from the backside thereof (from the side of the nozzle plate 31). FIG. 8 is an enlarged-view of the region surrounded by an alternate long and short dashed line shown in FIG. 7. As shown in FIGS. 6 to 8, the plurality of communication holes 60 (serving as holes or flow-path formation holes) are formed in the cover plate 30 so as to correspond to the plurality of pressure chambers 10 and the plurality of nozzles 8 (see FIG. 4), which are arranged in the matrix pattern. Specifically, the communication holes 60 are arranged in a plurality of rows along the longitudinal direction (the main scanning direction) of the cover plate 30. The communication holes 60 arranged in the plurality of rows are classified into five groups 60*a*, 60*b*, 60*c*, 60*d*, and 60*e*, which are spaced apart from each other in the lateral direction of the cover plate 30. The groups 60*a*, 60*b*, 60*c*, 60*d*, and 60*e* include, in sequence from the top of FIG. 7 (i.e., the lower side of the trapezoidal region), two rows, four rows, four rows, four rows, and two rows of the communication holes 60, respectively.

As shown in FIGS. 6 and 7, the plurality of annular escape grooves 30*a* surrounding the plurality of respective communication holes 60 are arranged on the surface (the lower surface) of the cover plate 30 to be bonded to the nozzle plate 31, in the longitudinal direction of the cover plate 30. The plurality of annular escape grooves 30 a assigned to the plurality of respective communication holes 60 belonging to one of the communication-hole groups 60*a* to 60*e* communicate with the adjacent annular escape grooves 30*a* through coupling grooves 30*b*. An escape groove (an encircling groove 30*c*) for encircling the entire group of the annular escape grooves 30*a* assigned to each of the five communication-hole groups 60*a* to 60*e* is also formed in the lower surface of the cover plate 30. The encircling grooves 30*c* communicate with each other through lattice-shaped escape grooves (lattice grooves 30*d*). Specifically, grooves of different shapes are arranged from the respective communication holes 60 to the outside in sequence of the annular escape grooves 30*a*, the coupling grooves 30*b*, the encircling grooves 30*c*, and the lattice grooves 30*d*, so as to surround the holes and grooves located inside thereof. All of the grooves are common to each other in view of allowing an excessive adhesive to escape. However, the annular escape grooves 30*a* close to the communication holes 60 regulate the amount of adhesive flowing into the communication holes 60, to thus make the amount of in flowing adhesive uniform. The outermost lattice groove 30*d* prevent air bubbles from remaining in the face to be bonded, so as to ensure reliable bonding, by means of dividing a wide bonding region into a lattice region of predetermined area. The encircling groove 30*c* located in the middle regulate the amount of excessive adhesive flowing into an inside region thereof from an outside region thereof, in order to ensure the function of the annular escape groove 30*a*. The annular escape grooves 30*a*, the coupling grooves 30*b*, the encircling grooves 30*c*, and the lattice grooves 30*d* are respectively formed by means of half-etching.

In the state where the ten plates 22 to 31 are stacked, regions between the communication-hole groups 60*a* to 60*e* face to the sub-manifolds 5*a* formed of the four manifold plates 26 to 29 located above the cover plate 30. Accordingly, when the ten plates 22 to 31 are stacked with the respective mating faces thereof being coated with the adhesive and the ten plates 22 to 31 are pressurized to be bonded by a single operation, the regions facing the sub-manifolds 5*a* become less pressurized. So, the edges of the annular escape grooves 30*a* on the side of the sub-manifolds 5*a* and the edges of the sub-manifolds 5*a* are formed to be parallel to each other in plan view, so that the annular escape grooves 30*a* and the sub-manifolds 5*a* don't overlap each other. A wide bonding region, which is located in the vicinity of the communication holes 60 and immediately outside the sub-manifolds 5*a* when viewed from above, can be ensured, to thereby prevent ink from leaking from this region.

As shown in FIG. 8, of the plurality of annular escape grooves 30*a* arranged in the longitudinal direction of the cover plate 30, the annular escape groove 30*a* located in the position of the outermost end (the left end in FIG. 8) communicates with the encircling groove 30*c* outside the annular escape groove 30*a*. As shown in FIGS. 7 and 8, the encircling groove 30*c* also communicates with escape grooves 30*e* surrounding the recessed portion 61 that forms the damper chamber 65, as well as with a lattice-shaped escape groove 30*f* formed in a region, which is outside the recessed portion 61 in terms of the longitudinal direction. Moreover, the lattice-shaped escape groove 30*f* communicates with an atmosphere communication hole 30*g* formed in the vicinity of one end of the cover plate 30 separated from the region where the plurality of communication holes 60 are formed. This atmosphere communication hole 30*g* also communicates with the atmosphere through atmosphere communication holes (omitted from the drawings) formed in the respective remaining plates 22 to 29, which are located above the cover plate 30. Specifically, all the plurality of annular escape grooves 30*a* assigned to the plurality of respective communication holes 60 communicate with the atmosphere through the escape grooves 30*c*, 30*e*, 30*f* and the atmosphere communication hole 30*g* . Accordingly, when the cover plate 30 and the nozzle plate 31 are bonded together, conditions under which the adhesive should flow into the respective annular escape grooves 30*a* are equivalent among all the annular escape grooves 30*a*. Consequently, the amounts of adhesive flowing into the plurality of respective communication holes 60 become substantially uniform, and hence variations in the ejection characteristic of ink ejected from the plurality of nozzles 8 become smaller.

As shown in FIG. 7, the atmosphere communication hole 30*g* is formed in the vicinity of the end of the cover plate 30 separated from the communication holes 60 through which ink flows. Hence, in the unlikely event of ink leaking out from the space between the cover plate 30 and the nozzle plate 31, the thus-leaked ink is less likely to escape to the outside from the atmosphere communication hole 30*g* through the escape grooves such as the annular escape grooves 30*a*, and the like.

Figure 9:
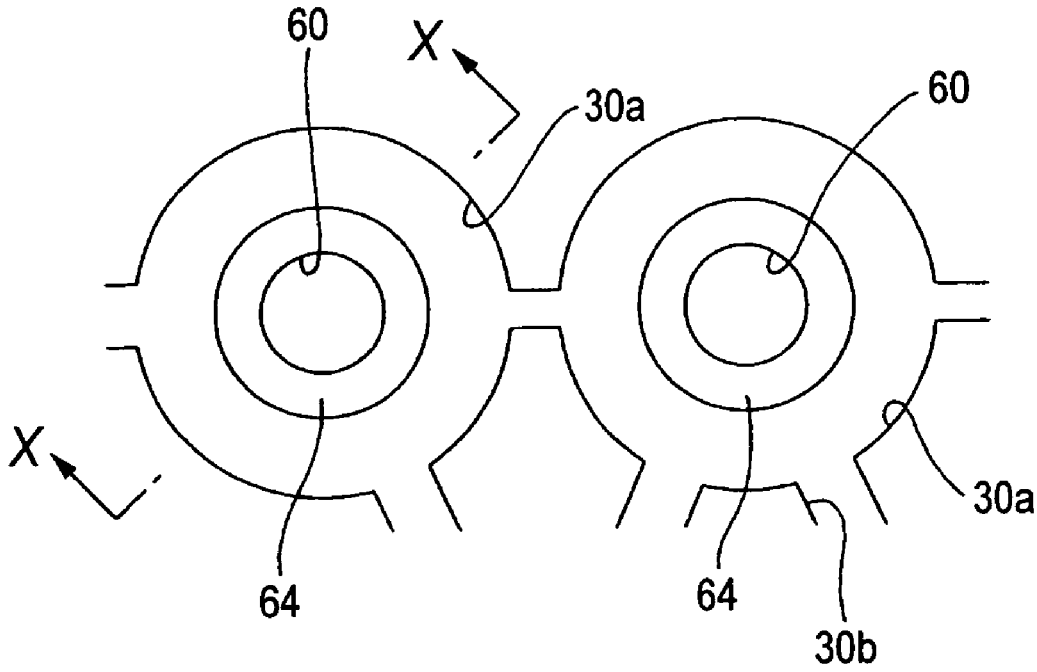
FIG. 9 is an enlarged view of a region including annular escape grooves shown in FIG. 8.

As shown in FIGS. 8 and 9, bonding regions 64 of the cover plate 30, which are located around the communication holes 60 and are to be coated with an adhesive, are annular regions, which are defined by opening edges of the communication holes 60 and the inner peripheries of the opening edges of the annular escape grooves 30*a* assigned to these communication holes 60. With regard to the plurality of communication holes 60, all the annular bonding regions 64 have the same width. Since the amount of adhesive 66 used for coating becomes substantially equal among the plurality of bonding regions 64 surrounding the plurality of communication holes 60, the amount of adhesive flowing into the communication holes 60 can be made further uniform. Since all such annular bonding regions 64 have the same width, an advantage that the amount of adhesive flowing into the communication holes 60 are made uniform is achieved even when the annular escape grooves 30*a* don't communicate with the atmosphere. When compared with the case where the annular escape grooves 30*a* communicate with the atmosphere, the amount of in flowing adhesive tends to become slightly greater.

Figure 10:
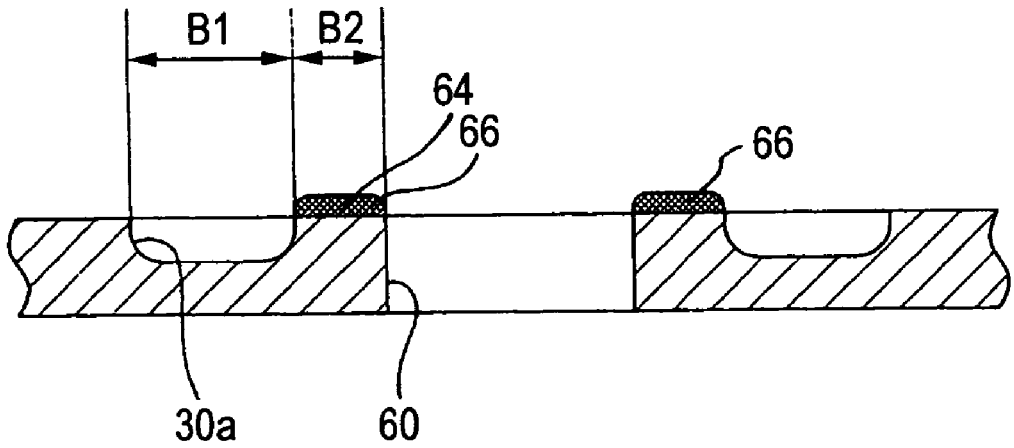
FIG. 10 is a section view taken along line X-X in FIG. 9.

As shown in FIG. 10, a width B1 of the annular escape groove 30*a* is larger than a width B2 of the annular bonding region 64. The internal volume of the annular escape groove 30*a* is greater than the amount of adhesive 66 used for coating the bonding region 64. Accordingly, a location—where the excessive adhesive 66, which would run off the bonding region 64 when the plates 22 to 31 are pressurized, escapes—can be sufficiently ensured. The adhesive 66, which has failed to escape into the annular escape groove 30*a*, does not flow into the communication hole 60. In other words, even when the adhesive flows into the communication hole 60, the amount of in flowing adhesive is determined by the width of the bonding region 64 and the amount (thickness) of the adhesive 66 applied over the upper surface of the bonding region, and the amount of the in flowing adhesive 66 can be reliably made more uniform.

Figure 11A:
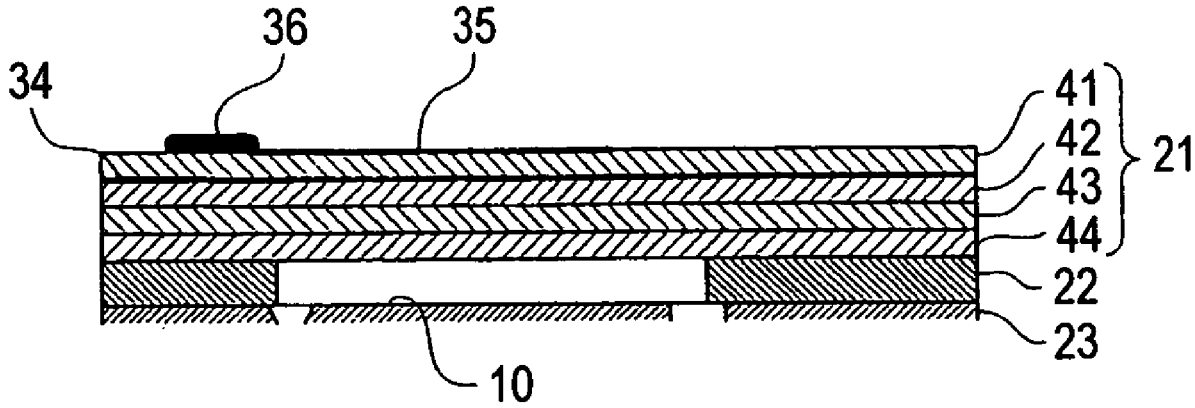
FIG. 11A is a partially enlarged section view of an actuator unit.
Figure 11B:
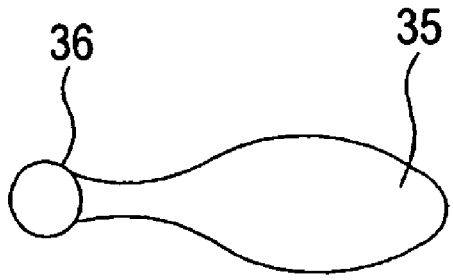
FIG. 11B is a plan view of individual electrodes and land portions.

The structure of the actuator unit 21 will now be described with reference to FIGS. 11A and 11B. As shown in FIGS. 11A and 11B, the actuator unit 21 includes four piezoelectric sheets 41 to 44, a plurality of individual electrodes 35 and a common electrode 34. The four piezoelectric sheets 41 to 44 extend across the plurality of pressure chambers 10. The plurality of individual electrodes 35 are disposed on the uppermost piezoelectric sheet 41 in positions corresponding to the plurality of respective pressure chambers 10. The common electrode 34 faces the plurality of individual electrodes 35 with the piezoelectric sheet 41 of the topmost layer sandwiched therebetween.

The piezoelectric sheets 41 to 44 have substantially the same thickness (e.g., 15 μm or thereabouts); are consecutively arranged across the plurality of pressure chambers 10; and are bonded to the cavity plate 22. The plurality of individual electrodes 35 are formed at high density on the piezoelectric sheet 41 through use of the screen printing technique or the like. The piezoelectric sheets 41 to 44 are made of a piezoelectric material having ferroelectricity, such as a lead-zirconate-titanate (PZT)-based ceramic material.

As shown in FIGS. 11A and 11B, the individual electrodes 35 have a rhombic shape, which is substantially analogous to that of the pressure chambers 10 and is smaller than that of the pressure chambers 10. Each of the individual electrodes 35 is formed in a region on the upper surface of the piezoelectric sheet 41 of the topmost layer, the region falling within the pressure chamber 10 when viewed from above. The individual electrodes 35 are arranged in a matrix pattern as are the pressure chambers 10. In relation to all the individual electrodes 35, one of the acute-angle portions of each individual electrode 35 extends in a single direction. As shown in FIG. 11B, a land portion 36 is provided in this acute-angle portion. The land portion 36 has a circular shape having a diameter of about 160 μm, and is made of gold containing, e.g., glass frit. The land portion 36 is electrically coupled to contact points provided on the FPC 50 (see FIGS. 1 and 2). A drive signal used for changing the volume of the pressure chamber 10 is input to the individual electrode 35 from the driver IC 80 (see FIGS. 1 and 2) through the land portion 36.

The common electrode 34 is formed over the entire space between the piezoelectric sheet 41 of the topmost layer and the piezoelectric sheet 42 of a lower layer. The thickness of the common electrode 34 is on the order of about 2 μm. The common electrode 34 is connected to the ground in an unillustrated region and held at a ground potential in the regions facing all the pressure chambers 10.

The individual electrodes 35 and the common electrode 34 are made of, e.g., Ag—Pd-based metallic material.

A method for driving the actuator unit 21 will now be described. The polarizing direction of the piezoelectric sheet 41 in the actuator unit 21 is identical with the thickness direction of the piezoelectric sheet 41. Specifically, the actuator unit 21 has a configuration of so-called unimorph type, wherein the upper single piezoelectric sheet 41 (i.e., the piezoelectric sheet separated from the pressure chamber 10) is used as an active layer and the lower three piezoelectric sheets 42 to 44 (i.e., the piezoelectric sheets close to the pressure chamber 10) are collectively used as non-active layers. It is assumed that the individual electrode 35 is at a predetermined positive or negative potential. When the electric field and polarization are oriented in the same direction, an electric-field-applied portion of the piezoelectric sheet 41 sandwiched between the individual electrode 35 and the common electrode 34 acts as the active layer to shrink in a direction perpendicular to the polarization direction due to the transverse piezoelectric effect. On the other hand, the piezoelectric sheets 42 to 44 are not affected by the electric field, so that the piezoelectric sheets 42 to 44 do not shrink spontaneously. Therefore, a difference in distortion in the direction perpendicular to the polarization direction arises between the piezoelectric sheet 41 of an upper layer and the piezoelectric sheets 42 to 44 of the lower layers, so that the piezoelectric sheets 41 to 44 as a whole attempt to deform convexly toward the non-active side (unimorph deformation). At this time, as shown in FIG. 11A, the lower surfaces of the piezoelectric sheets 41 to 44 are fixed to the upper surface of the cavity plate 22, which defines the pressure chamber 10. Consequently, the piezoelectric sheets 41 to 44 deform convexly toward the pressure chamber 10. This decreases the volume of the pressure chamber 10, which in turn increases the pressure of ink, whereupon ink is ejected from the nozzle 8. Subsequently, when the individual electrode 35 is brought to the same electric potential as that of the common electrode 34, the piezoelectric sheets 41 to 44 restore their original shapes, whereupon the volume of the pressure chamber 10 returns to its original volume. Thus, ink is sucked from the manifold 5.

According to another driving method, the individual electrode 35 may have previously been brought to an electric potential different from that of the common electrode 34, and the individual electrode 35 may be temporarily brought to the same electric potential as that of the common electrode 34 every time an ejection request is made. Subsequently, the individual electrode 35 may be brought to the electric potential different from that of the common electrode 34 at predetermined timing. In this case, the piezoelectric sheets 41 to 44 restore their original shapes at timing when the individual electrode 35 has the same electric potential as that of the common electrode 34. The volume of the pressure chamber 10 increases in relation to the initial state (the state where the individual electrode and the common electrode differ from each other in terms of the electric potential), so that ink is sucked into the pressure chamber 10 from the manifold 5. Subsequently, the piezoelectric sheets 41 to 44 are deformed so as to become convex toward the pressure chamber 10 at timing when the individual electrode 35 is brought to the electric potential different from that of the common electrode 34, and the pressure of ink is increased due to decrease in the volume of the pressure chamber 10, to thereby eject ink.

In the above-described inkjet head 1, all the plurality of annular escape grooves 30*a* of the cover plate 30 provided in correspondence with the plurality of communication holes 60 communicate with the atmosphere. Hence, when the cover plate 30 and the nozzle plate 31 are bonded together, the conditions under which the adhesive flows into the respective annular escape grooves 30*a* are equivalent among all the annular escape grooves 30*a*. Consequently, the amounts of adhesive flowing into the plurality of respective communication holes 60 are substantially uniform, and hence variations in the ejection characteristic of ink ejected from the plurality of nozzles 8 can be suppressed.

Modified embodiments, which are achieved by imparting various modifications to the embodiment, will now be described. Those elements, which have the same configurations as those of the embodiment, are assigned the same reference numerals, and their explanations will be omitted.

Figure 12:
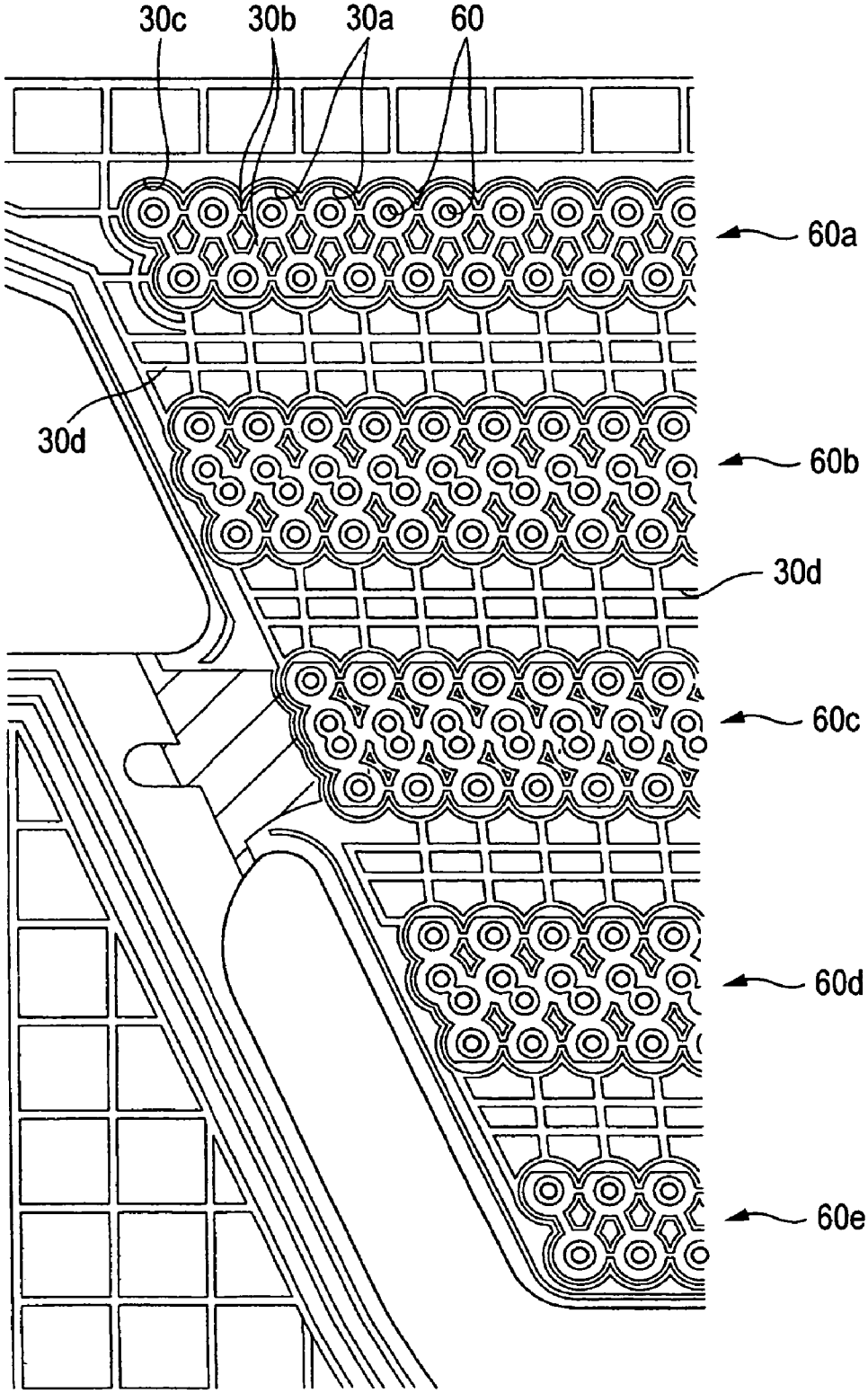
FIG. 12 is a view of a modification embodiment, which is a counterpart of FIG. 8.

1] As shown in FIG. 12, with regard to all the five communication hole groups 60*a* to 60*e* formed in the cover plate 30, the plurality of annular escape grooves 30*a* assigned to the plurality of communication holes 60, which belong to each of the communication-hole groups 60*a* to 60*e*, may communicate with each other through the communication grooves 30*b*, but may not communicate with the encircling groove 30*c* encircling the outside of the annular escape grooves 30*a*. In this case, each groove group of the plurality of annular escape grooves 30*a* may be closed while the plurality of annular escape grooves 30*a* thereof communicate with each other. Even in this case, when the cover plate 30 and the nozzle plate 31 are bonded together, conditions under which the adhesive flows into the annular escape grooves 30 are equivalent among all the annular escape grooves 30*a*. Consequently, the amounts of adhesive flowing into the plurality of respective communication holes 60 are substantially uniform, and hence variations in the ejection characteristic of ink ejected from the plurality of nozzles 8 can be suppressed.

2] The embodiment (see FIG. 8) and the previously-described modification (see FIG. 12) are examples where the invention is applied to the annular escape grooves 30*a* surrounding the communication holes 60 formed in the cover plate 30. Alternatively, the invention may also be applied to the annular escape grooves 23*a* to 29*a* (see FIG. 5) surrounding the holes formed in another plate constituting the flow path unit 4. For example, the invention maybe applied to the annular escape grooves 29*a* surrounding the communication holes formed in the manifold plate 29 (see FIG. 5) bonded to the upper surface of the cover plate 30. If all the plurality of annular escape grooves 29*a* communicate with the atmosphere or each group of the annular escape grooves 29*a* are closed while the annular escape grooves 29*a* thereof communicate with each other, the amounts of adhesive flowing into the communication holes are rendered uniform and variations in the ejection characteristic of ink ejected from the nozzles 8 can be suppressed.

The apertures 12, which bring the sub-manifolds 5*a* to communicate with the pressure chambers 10, narrow the flow paths so that the pressure waves, which have been generated in the pressure chambers 10 when the ink in the pressure chambers 10 is pressurized by the actuator unit 21, are propagated less strongly to the sub-manifolds 5*a*. The flow path area of the aperture 12 is comparatively smaller than the other portions of the individual ink flowpath. However, when variations arise in the amounts of adhesive flowing into the apertures 12 when the aperture plate 24 and the supply plate 25 are bonded together, large variation in the flow path resistance of the apertures 12 are caused, because the flow path area of the apertures 12 is small. Accordingly, the invention may be applied to the annular escape grooves 24*b* surrounding the apertures 12 of such a small flow path area. Thereby, all the plurality of annular escape grooves 24*b* surrounding the plurality of apertures 12 communicate with the atmosphere or each group of the plurality of annular escape grooves 24*a* is closed while the plurality of annular escape grooves 24*a* thereof communicate with each other. In this case, the amounts of adhesive flowing into the plurality of apertures 12 can be made uniform, and variations in the flow path resistance of the apertures 12 can be suppressed.

What is claimed is:

1. An inkjet head comprising:

an ink flow path unit comprising:

a common ink chamber; and a plurality of individual ink flow paths each of which extends from the common ink chamber to a nozzle through a pressure chamber, wherein:

the ink flow path unit comprises a plurality of stacked plates comprising first and second plates, at least a portion of the plurality of individual ink flow paths are formed in the plurality of stacked plates, the first plate is formed with a plurality of holes that form the portion of the plurality of individual ink flow paths, one surface of the first plate is formed with a plurality of annular escape grooves that surround the plurality of holes, respectively, and all the plurality of annular escape grooves communicate with an atmosphere.

2. The inkjet head according to claim 1, wherein the plurality of annular escape grooves allow an adhesive used for bonding the first plate to the second plate to escape thereinto.

3. The inkjet head according to claim 1, wherein the holes formed in the first plate communicate with the nozzles formed in the second plate, respectively.

4. The inkjet head according to claim 1, wherein the holes formed in the first plate bring the common ink chamber into communication with the pressure chambers, respectively.

5. The inkjet head according to claim 1, wherein:

a bonding region to which the adhesive is applied is defined between an opening edge of each hole and an inner periphery of the annular escape groove assigned to the hole, the bonding region has an annular shape to surround the hole, and all the annular bonding regions have the same width.

6. The inkjet head according to claim 5, wherein a width of each annular escape groove is greater than a width of the annular bonding region.

7. The inkjet head according to claim 3, wherein:

the plurality of holes are arranged to be divided into a plurality of hole groups, the annular escape grooves are arranged to be divided into a plurality of groove groups, each groove group corresponds to one of the hole groups, the annular escape grooves belonging to each groove group communicate with each other, and each groove group of the annular escape grooves has an edge partially parallel to an edge of the common ink chamber in plan view.

8. The inkjet head according to claim 1, wherein:

the plurality of holes are arranged to be divided into a plurality of hole groups, the annular escape grooves are arranged to be divided into a plurality of groove groups, each groove group corresponds to one of the hole groups, the annular escape grooves belonging to each groove group communicate with each other, the escape grooves of each groove group are arranged in at least one row, the one surface of the first plate is formed with second grooves, one of the escape grooves of each groove group located at one end of each row communicates with one of the second grooves, the second grooves communicate with an atmosphere hole formed in the plates, and the atmosphere hole communicates with the atmosphere.

9. The inkjet head according to claim 1, wherein:

the plurality of holes are divided into a plurality of hole groups;

the plurality of annular escape grooves are divided into plurality of escape groove groups that correspond to the plurality of hole groups; and each of the annular escape grooves in each of escape groove groups are in fluid communication with each of the other annular escape grooves.

10. An inkjet head comprising:

an ink flow path unit comprising:

a common ink chamber; and a plurality of individual ink flow paths each of which extends from the common ink chamber to a nozzle through a pressure chamber, wherein:

the ink flow path unit comprises a plurality of stacked plates comprising first and second plates, at least a portion of the plurality of individual ink flow paths are formed in the plurality of stacked plates, the first plate is formed with a plurality of holes that form the portion of the plurality of individual ink flow paths, the plurality of holes are arranged to be divided into a plurality of hole groups, one surface of the first plate is formed with a plurality of annular escape grooves that surround the plurality of holes, respectively, the annular escape grooves are arranged to be divided into a plurality of groove groups, each groove group corresponds to one of the hole groups, the annular escape grooves belonging to each groove group communicate with each other, and each groove group of the annular escape grooves is closed.

11. The inkjet head according to claim 10, wherein the plurality of annular escape grooves allow an adhesive used for bonding the first plate to the second plate to escape thereinto.

12. The inkjet head according to claim 10, wherein the holes formed in the first plate communicate with the nozzles formed in the second plate, respectively.

13. The inkjet head according to claim 10, wherein the holes formed in the first plate bring the common ink chamber into communication with the pressure chambers, respectively.

14. The inkjet head according to claim 10, wherein: a bonding region to which the adhesive is applied is defined between an opening edge of each hole and an inner periphery of the annular escape groove assigned to the hole, the bonding region has an annular shape to surround the hole, and all the annular bonding regions have the same width.

15. The inkjet head according to claim 14, wherein a width of each annular escape groove is greater than a width of the annular bonding region.

16. The inkjet head according to claim 12, wherein each groove group of the annular escape grooves has an edge partially parallel to an edge of the common ink chamber in plan view.

* * * * *